US010787341B2

(12) United States Patent
Herkel et al.

(10) Patent No.: US 10,787,341 B2
(45) Date of Patent: Sep. 29, 2020

(54) ELEVATOR CONTROL SYSTEM AND ELEVATOR SYSTEM HAVING INSPECTION CONTROL STATION

(71) Applicants: Otis Elevator Company, Farmington, CT (US); Peter Herkel, Berlin (DE)

(72) Inventors: Peter Herkel, Berlin (DE); Michael Mann, Berlin (DE); Helmut Lothar Schroeder-Brumloop, Berlin (DE); Pascal Rebillard, Gien (FR); Igor Kuzmin, St. Petersburg (RU)

(73) Assignee: OTIS ELEVATOR COMPANY, Farmington, CT (US)

( * ) Notice: Subject to any disclaimer, the term of this patent is extended or adjusted under 35 U.S.C. 154(b) by 272 days.

(21) Appl. No.: 15/740,674

(22) PCT Filed: Jul. 1, 2015

(86) PCT No.: PCT/EP2015/064946
§ 371 (c)(1),
(2) Date: Dec. 28, 2017

(87) PCT Pub. No.: WO2017/001005
PCT Pub. Date: Jan. 5, 2017

(65) Prior Publication Data

US 2018/0186602 A1 Jul. 5, 2018

(51) Int. Cl.

| | |
|---|---|
| ***B66B 5/00*** | (2006.01) |
| ***B66B 1/34*** | (2006.01) |
| ***B66B 9/00*** | (2006.01) |

(52) U.S. Cl.
CPC ..... *B66B 5/0087* (2013.01); *B66B 1/3407* (2013.01); *B66B 1/3461* (2013.01); *B66B 9/00* (2013.01); *B66B 2201/00* (2013.01)

(58) Field of Classification Search
CPC ... B66B 5/0087; B66B 5/0025; B66B 5/0037; B66B 5/0062; B66B 1/3407; B66B 1/3461; B66B 9/00
(Continued)

(56) References Cited

U.S. PATENT DOCUMENTS

| | | | |
|---|---|---|---|
| 3,203,506 | A | 8/1965 | Cummins |
| 5,554,832 | A | 9/1996 | Lumme et al. |

(Continued)

FOREIGN PATENT DOCUMENTS

| | | | |
|---|---|---|---|
| EP | 1148018 | A1 | 10/2001 |
| EP | 2072444 | A1 | 6/2009 |

(Continued)

OTHER PUBLICATIONS

International Search Report and Written Opinion for application PCT/EP2015/064946, dated Mar. 22, 2016, 12 pages.

*Primary Examiner* — Christopher Uhlir
(74) *Attorney, Agent, or Firm* — Cantor Colburn LLP

(57) ABSTRACT

Elevator control system, comprising an elevator control device for operating an elevator car which is adapted to be operated within an elevator shaft, and an inspection control station configured to communicate with the elevator control device for operating at least one function of an elevator system in an inspection or maintenance operation mode, and configured for attachment at a storing location, wherein the storing location is at the elevator car or within the elevator shaft or in proximity of the elevator shaft. The inspection control station is adapted to be detachable from the storing location and configured to operate as remote inspection control station when detached from the storing location through wireless communication with the elevator control device, and is configured to be movable and operable in the
(Continued)

inspection or maintenance operation mode from inside and outside of the elevator car and within the elevator shaft.

18 Claims, 4 Drawing Sheets

(58) Field of Classification Search
USPC ..... 187/247, 380–389, 391, 393, 395, 396
See application file for complete search history.

(56) References Cited

U.S. PATENT DOCUMENTS 6,202,797 B1 3/2001 Skolnick et al.
6,330,935 B1 * 12/2001 Systermans ..... B66B 5/0025 187/391
6,467,585 B1 10/2002 Gozzo et al.
6,481,531 B1 11/2002 Nagura et al.
6,868,945 B2 3/2005 Schuster et al.
6,986,408 B2 1/2006 Takeuchi
7,004,289 B2 * 2/2006 Shrum, III ..... B66B 5/0037 187/393
7,073,633 B2 * 7/2006 Weinberger ..... B66B 5/0025 187/393
7,264,090 B2 9/2007 Vecchiotti et al.
7,426,981 B2 9/2008 Bacellar et al.
8,490,755 B2 * 7/2013 Lindberg ..... B66B 13/22 187/314
8,678,143 B2 * 3/2014 Bunter ..... B66B 5/0025 187/393
9,403,663 B2 * 8/2016 Dellarippa ..... B66B 1/34
9,573,791 B2 * 2/2017 Garcia ..... B66B 11/0005
9,580,276 B2 * 2/2017 Toutaoui ..... B66B 1/3461
9,944,492 B2 * 4/2018 Lustenberger ..... B66B 5/0031
9,950,899 B2 * 4/2018 Mattsson ..... B66B 1/3476
10,112,801 B2 * 10/2018 Madarasz ..... B66B 5/0037
10,183,837 B2 * 1/2019 Kusserow ..... B66B 1/3461
10,244,374 B2 * 3/2019 Ginsberg ..... H04L 67/34
2014/0069745 A1 3/2014 Dellarippa et al.

FOREIGN PATENT DOCUMENTS

JP 01281277 A * 11/1989
JP 2003306277 A 10/2003
WO 02066357 A1 8/2002
WO 2003086935 A1 10/2003
WO 2008072023 A1 6/2008
WO 2011015895 A1 2/2011

* cited by examiner

ELEVATOR CONTROL SYSTEM AND ELEVATOR SYSTEM HAVING INSPECTION CONTROL STATION

BACKGROUND

The present disclosure relates to an elevator control system with an elevator control device for operating an elevator car and an inspection control station configured to communicate with the elevator control device. The present disclosure also relates to an elevator system comprising an elevator car and an elevator shaft and such elevator control system.

Elevator systems involve particular safety requirements, wherein hardware or software used to control operation of elevators is to a significant part subject to specific conditions in order to meet such safety requirements. Particular levels of safety integrity requirements exist, depending on the degree of safety relevance of the respective functions or operations of the elevator system controlled. For example, specific safety rules for the construction and installation of lifts are contained in European standard EN 81-20 issued November 2014 (EN 81-20:2014-11, in the following referred to as EN 81-20(2014), particularly the English version thereof).

In elevator systems, safety critical operations are controlled, or at least monitored, using sensor and/or switching devices (in the following simply referred to as safety switches) connected to a safety controller which may be part of an elevator control device for operating the elevator system. Safety switches are often used at the various "safety points", at which the state of safety critical components (e.g. the position of movable components, such as doors) must be monitored prior to the initiation of an action and, if necessary, during the course of this action. In typical configurations a number of these safety switches are, in particular, connected in series to form a so-called "safety chain" so that the action can only be started or continued when all the safety switches or, in more general terms, switching devices take up a predetermined switching state. For example, in the case of an elevator system it must be ensured that before the start and during the travel of the elevator car all doors (car doors as well as landing doors on each floor) remain closed and mechanically locked. Therefore, travel of an elevator car is in general not allowed unless all of the safety switches in a safety chain connecting respective safety switches monitoring the closing state of the doors are closed.

Conventionally, existing inspection control buttons and switches are directly wired into the safety chain. The above mentioned standard EN 81-20(2014) requires an additional inspection control station, particularly a permanently installed inspection control station, such as in the pit or in working areas in the car or on the car roof (cf. sections 5.2.1.5, 5.2.6.4.3 and 5.12.1.5). Particularly, the inspection control station shall comprise an inspection switch, direction push buttons "Up" and "Down" and a push button "Run" protected against accidental operation, and a stopping device. It may also incorporate special switches protected against accidental operation for controlling the mechanism of doors from the car roof. Further, it may be that newly designed elevators have an inspection operation made from inside the elevator. As a result, there might be three or more different locations for inspection control stations, although a considerable inspection or maintenance work is done by a single technician performing the inspection or maintenance. This may involve a considerable time and effort for the technician.

It would be beneficial to provide an elevator control system and an elevator system which allow a technician to perform the inspection or maintenance more efficiently.

SUMMARY

Embodiments described herein provide an elevator control system, comprising an elevator control device for operating an elevator car which is adapted to be operated within an elevator shaft, an inspection control station configured to communicate with the elevator control device for operating at least one function of an elevator system in an inspection or maintenance operation mode, and configured for attachment at a storing location of the elevator system, wherein the storing location is at the elevator car or within the elevator shaft or in proximity of the elevator shaft. The inspection control station is adapted to be detachable from the storing location and configured to operate as remote inspection control station when detached from the storing location through wireless communication with the elevator control device, wherein the inspection control station is configured to be movable and operable in the inspection or maintenance operation mode from inside and outside of the elevator car and within the elevator shaft.

Further embodiments relate to an elevator system, comprising an elevator car and an elevator shaft, wherein the elevator car is adapted to be operated within the elevator shaft, an elevator control system according to embodiments described herein, and a storage location for the inspection control station at the elevator car or within the elevator shaft or in proximity of the elevator shaft. The inspection control station is attached at the storing location and adapted to be detachable from the storing location for operating as remote inspection control station when detached from the storing location through wireless communication with the elevator control device.

BRIEF DESCRIPTION OF THE DRAWINGS

Aspects and embodiments of the invention will be described in more detail by way of exemplary embodiments as shown in the Figures.

DETAILED DESCRIPTION

Figure 1:
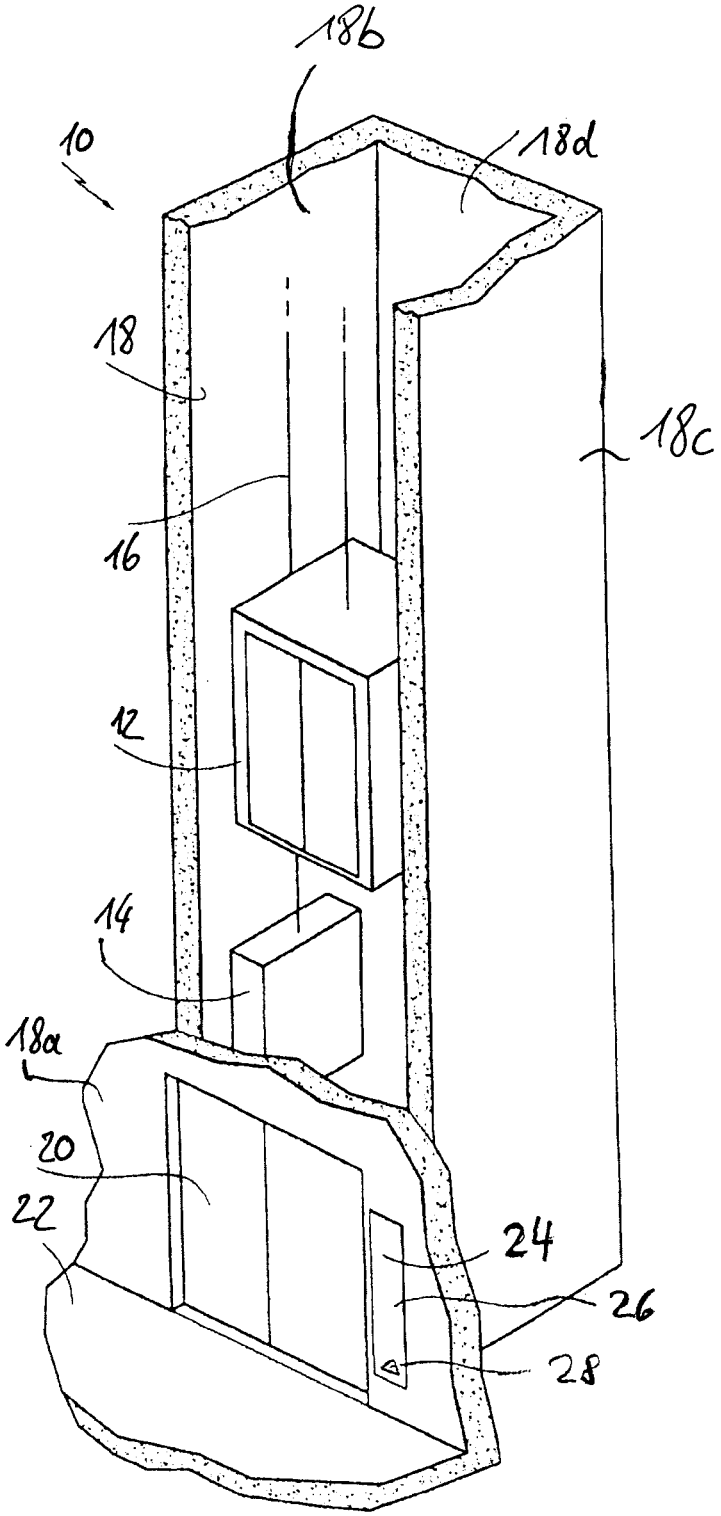
FIG. 1 shows an elevator system according to an embodiment.
Figure 2:
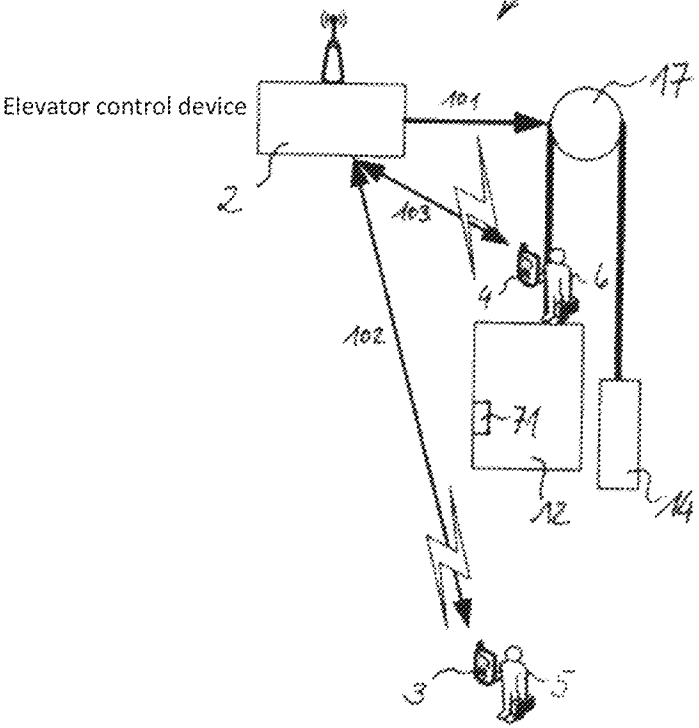
FIG. 2 shows a schematic diagram of an elevator system including an elevator control system comprising several inspection control stations according to an embodiment and an elevator control device in communication with the inspection control stations.

FIG. 1 shows an elevator system 10 according to an embodiment in a schematic and simplified perspective view. Elevator system 10 comprises an elevator car 12 and a counterweight 14 connected by a tension member 16 in the configuration of a rope or belt (tension member 16 is only indicated schematically in FIG. 1). Tension member 16 is driven by an elevator drive 17, e.g. a traction drive, which is not shown in FIG. 1, but only shown in FIG. 2, such as to move elevator car 12 and counterweight 14 along an elevator shaft 18. Although the top part of the elevator shaft 18 is not shown in FIG. 1, the elevator drive 17 is located in the top part of the elevator shaft above the highest landing, such as schematically shown in FIG. 2. Elevator car 12 and counterweight 14 move along guide rails which are also not shown in FIG. 1. Elevator shaft 18 has an essentially rectangular cross section and is surrounded by four vertically extending side walls three of which (left side wall 18*b*, right side wall 18*c*, back wall 18*d*) are shown in FIG. 1. The front wall of the elevator shaft is omitted in FIG. 1 to show the elevator car and counterweight. Only at the lowest landing 22 a portion of front wall 18*a* is visible with a landing door 20 being formed in front wall 18*a*. Not shown is a hall operating panel for entering hall calls. Front wall 18*a* will have a similar configuration at other landings.

Different from the other landings, at the lowest landing 22 a control board 24 is provided in the front wall 18*a* of the elevator shaft 18. The control board 24 may include a respective access point for signal transmission, as described in more detail below. Control board 24 is closed by a front panel 26 which is itself locked by a key lock 28. Key lock 28 can be opened by inserting a suitable key, e.g. a triangular key, into the key hole of key lock 28. Once front panel 26 is opened, hardware of the control board, such as the hardware of the access point, will be accessible by a technician. Alternatively to the embodiment shown in FIG. 1, the control board 24 may be located at any landing or in the vicinity of the elevator system 10 in other embodiments. Control boards may be provided in only one landing, several landings, or all landings of the elevator system.

FIG. 2 shows a schematic diagram of an elevator system including an elevator control system 1 which comprises an elevator control device 2 in communication with several inspection control stations 3, 4 according to an embodiment. In the exemplary embodiment, two inspection control stations 3, 4 are shown, but in principle the elevator control system 1 may be operated with any appropriate number of inspection control stations.

For example, the elevator control device 2 may comprise one or more components in discrete or distributed arrangement. For instance, it may be located in a machine room, if existing, or in the pit or at the top of the elevator shaft, or at any other appropriate location within or in proximity of the elevator shaft, or may be distributed among those or other locations by respective components. For example, the elevator control device 2 comprises a main controller (not shown) for controlling overall operation of elevator functions, e.g. control of service requests, illumination of car and floors, emergency calls, general elevator safety functions, etc. Such main controller may be provided with information from various safety switches provided in the elevator car 12 and the elevator shaft 18, e.g. car position sensors indicating the position of the car in the elevator shaft, landing door position sensors indicating the closing state of landing doors, and others.

Elevator control device 2, for instance, further comprises a drive controller (not shown) for controlling the elevator drive 17 driving the elevator car 12 via signal communication path 101 as well as the brakes stopping or preventing movement of the elevator car 12. Elevator control device 2 may further comprise a door controller (not shown) for controlling the door drive of the elevator car 12 driving the doors of the elevator car 12 such as to open and close the car doors and landing doors when the elevator car 12 stops at a landing. Car doors are operated directly by the door drive while the respective landing doors are operated indirectly via movement of the car doors when the car doors open or close at a landing.

Information on the state of any of the safety switches assigned to main controller, drive controller, and door controller, respectively, is communicated via respective data connections. Usually, a bus system is used for these purposes. A popular bus system includes a serial field bus system, e.g. a CAN bus system. For example, a safety unit (not shown) comprised in the elevator control device 2 receives status information from any of the safety switches. It evaluates this information in the configuration of a safety chain. Usually, such safety unit controls a plurality of safety chains relevant with respect to different subsystems of the elevator system, respectively (e.g. a safety chain with respect to the main power supply of the elevator system, a safety chain with respect to the drive of a car, or a safety chain with respect to the door drive of a car, etc.). A safety chain has the configuration of a serial connection of all relevant safety switches. In case only a single one of the safety switches in the safety chain does not show a proper status information (e.g. indicates a not fully closed state of a door), the status of that safety switch will be considered open. Due to the serial connection of the safety switches in the safety chain, any safety chain including that safety switch will be considered open indicating that the elevator system, or a respective subsystem of the elevator system (e.g. the car door drive), is considered to be in an unsafe condition. In such case, the safety unit will stop further operation of the elevator system, or of the respective elevator subsystem, until the safety chain is closed again. For example, the safety unit may interrupt power supply to the drive controller, in order to stop further movement of the car, interrupt power supply to the door controller to stop further movement of the car door, and/or interrupt power supply to the main controller to completely shut down the elevator system.

In certain periods of time, or upon installation in the elevator system, the elevator control system 1 may be subject to inspection or maintenance to be performed by one or more technicians. For example, control software provides for specific test procedures for checking the correct operation of each of the safety switches in the safety chains. For inspection or maintenance operation, the elevator control system is provided with an inspection control station, such as inspection control station 3. The inspection control station 3 is configured for operating at least one function of the elevator system in an inspection or maintenance operation mode, for example, at least one function as set out in standard EN 81-20(2014). For example, one function may be to control movement of the elevator car in up and down direction. Another function may be the control of opening and closing of the elevator car doors. In principle, the inspection control station 3 is capable of communicating with and controlling any of the functions of any of the controllers of the elevator control device 2, such as main controller, drive controller and/or door controller.

According to an embodiment, the inspection control station is configured to operate according to standard EN 81-20(2014). Reference is made in particular to sections 5.2.1.5, 5.2.6.4, and 5.12.1.5 thereof.

As to the configuration and function of the inspection control station, according to an embodiment, reference is made to the respective chapters of standard EN 81-20(2014) referring to such inspection control station. For example, the inspection control station comprises a switch (inspection operation switch) which shall satisfy the requirements for electric safety devices and shall be protected against involuntary operation, direction push buttons "UP" and "DOWN" protected against accidental operation with the direction of movement clearly indicated, a push button "RUN" protected against accidental operation, and/or a stopping device provided for stopping, and maintaining the elevator out of service, including the power operated doors. The inspection control station may also incorporate special switches protected against accidental operation for controlling the mechanism of doors from the car roof. In principle, any suitable inspection control station may be used for the purposes of the embodiments described herein.

Figure 3:
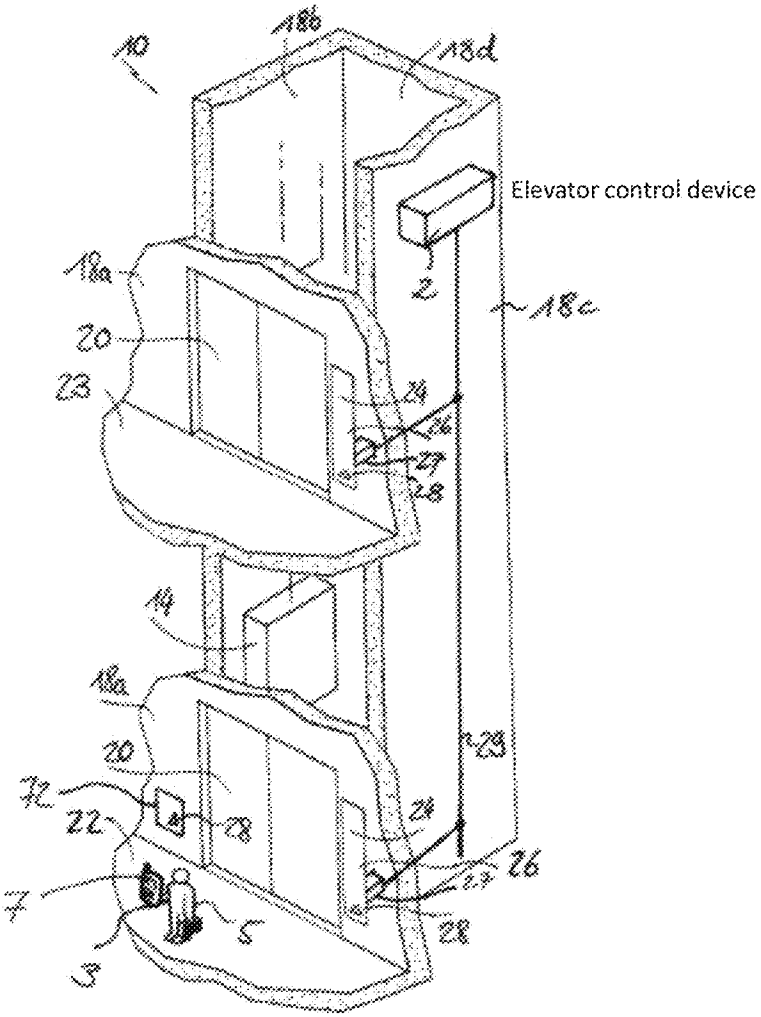
FIG. 3 shows an elevator system according to a further embodiment.

The elevator system 10 further comprises a storing location for the inspection control station 3, which may be located at the elevator car or within the elevator shaft or in proximity of the elevator shaft. An example of such storing location is shown in FIG. 2 with storing location 71 which is arranged in the elevator car 12 (for example behind the operation panel). For instance, the storing location 71 may be a housing located at the elevator car 12 (e.g. within or on top of the elevator car), such as shown in FIG. 2. Another example of such storing location is shown in FIG. 3 with storing location 72 arranged on a landing, e.g. the lowest landing 22. For instance, the storing location 72 may be a housing or cavity within front wall 18*a* comprising also a key lock 28. The inspection control station 3 may be located behind a respective door of the storing locations 71, 72 which is itself locked by a key lock. The key lock can be opened by inserting a suitable key, e.g. a triangular key, into the key hole of key lock by a technician having the appropriate key. Once the door is opened, the inspection control station will be accessible by a technician. According to an embodiment, the inspection control station 3 can be operated in an inspection or maintenance operation mode while being placed in or attached to the storing location, e.g. through wired connection with elevator control device 2.

In this way, a readily operable inspection control station can be permanently installed in any one of, e.g., on the elevator car roof, in the pit, in the elevator car, on a platform, within the elevator control device cabinet, and/or within or proximate to the elevator shaft.

Further, the inspection control station 3 is adapted to be detachable from the storing location 71, or 72, for operating as remote inspection control station when detached from the storing location through wireless communication with the elevator control device. For example, as shown in FIG. 2, the inspection control station 3 communicates with the elevator control device 2 through wireless signal communication path 102. Particularly, the inspection control station 3 is detachable from the storing location 71, or 72, and configured to operate as remote inspection control station when detached from the storing location through wireless communication with the elevator control device 2. With the use of safety electronics a wireless and still safe communication can be established between the inspection control station 3 and the elevator control device 2. The safety electronics may be employed to prevent any disturbances of data communication. The inspection control station 3 is configured to be movable and operable in the inspection or maintenance operation mode from inside and outside of the elevator car and within the elevator shaft.

Accordingly, it is possible to provide a single inspection control station that is portable, e.g. can be moved from the pit to the top of the elevator car, or inside the elevator car. Thus, a technician can perform the inspection or maintenance more efficiently, since the technician may use only one inspection control station which he or she can access and take from the storing location, detach it therefrom, and freely move with it within the elevator system for inspection or maintenance operation. Further, the technician is not required to carry any inspection control station with him which fits to the respective elevator installation. Rather, when arriving at a particular elevator installation, the technician is provided with the appropriate inspection control station at the respective storing location and which he may detach from the storing location, when needed, and use as a remote inspection control station within the elevator system. At the same time, any standard requirements, such as those according to EN 81-20(2014), may be complied with by providing the appropriate inspection control station at the storing location which complies with the respective standard requirements.

Further benefits are simplification of system wiring, especially of any safety chain used in the elevator control system, safe control of the elevator system for each technician at jobsite, and safe control of the elevator system independently from previously fixed location of the inspection control station.

According to an embodiment, the elevator control device is configured to perform communication between the inspection control station 3 and the elevator control device 2 by one or more of the following:

- wired plug connection,
- Near Field Communication,
- Infrared communication,
- wireless mesh network standard communication,
- wireless technology standard for exchanging data over short distances.

For example, a wireless mesh network standard communication works according to a specification for a suite of high-level communication protocols used to create area networks, as commonly known. According to an embodiment, a communication known under the term Zigbee may be used. According to an embodiment, wireless mesh network standard communication is based on an IEEE 802.15.4 standard.

According to a further embodiment, a wireless technology standard for exchanging data over short distances may be used. For example, the wireless technology standard for exchanging data over short distances may operate at frequencies in a band between 2400 and 2485 MHz. Bluetooth communication is an example of a particular wireless technology standard for exchanging data over short distances which may be used. Particularly, Bluetooth operates at frequencies in a band between 2400 and 2485 MHz. Bluetooth is managed by the Bluetooth Special Interest Group (SIG) and commonly known in the art.

FIG. 3 shows an elevator system according to a further embodiment. In particular, the elevator system of FIG. 1 is shown in more detail regarding connection of the control boards 24 and associated hardware to the elevator control device 2. Further, FIG. 3 shows the lowest landing 22 and a second landing 23 above. In particular, the elevator system 10 further comprises one or more access points 27 at a respective location of the elevator system. For example, the access points 27 may be located at the respective control board 24, but other locations are also possible. Each of the access points 27 is configured to transmit and receive signals to and from the inspection control station 3 when the latter is detached from the storing location 72, or signals to and from any further inspection control station, if any, such as inspection control station 4 according to FIG. 2. The transmission and reception of signals is performed through wireless communication between inspection control station and access point to communicate with the elevator control device 2 through the respective access points 27, particularly for transmitting and receiving appropriate control and data signals for controlling elevator operation and/or for receiving feedback status. In other words, each of the access points 27 is an intermediary of the signal communication between the inspection control station 3, 4 and the elevator control device 2. For example, each of the access points 27 may communicate with the inspection control station 3, 4 wirelessly, and with the elevator control device 2 through a communications bus 29. As such, each of the access points 27 includes appropriate signal processing hardware for performing the signal communication between the respective inspection control station 3, 4 and elevator control device 2 via communications bus 29.

According to an embodiment, the communications bus 29 is coupled with the elevator control device 2 and the one or more access points 27. For example, the communications bus 29 is a serial communications bus, such as a CAN bus.

According to an embodiment, the one or more access points 27 are located at one or more of the following locations: an inspection panel at a landing, a location where the elevator control device is placed, on top of the elevator car, inside the elevator car, and/or in the pit of the elevator shaft. A further potential location could be, as shown in FIG. 3, at one or more respective control boards of the elevator system.

According to an embodiment, the elevator control system may also be configured for a two-man operation in which a second (or any further) inspection control station can be added into the elevator control system, e.g. with on-site registration to the system.

According to an embodiment, for example as shown in FIG. 2, the elevator control device 2 is configured to further communicate with at least one second inspection control station 4 (the inspection control station 3 being a first inspection control station), e.g. via signal communication path 103, such that at least one function of the elevator system 10 is operable by the first inspection control station 3 and the second inspection control station 4 in a concurrent inspection or maintenance operation mode in which the first and second inspection control stations 3, 4 have concurrent control over the at least one function of the elevator system 10.

Particularly, the second inspection control station 4 (and/or any further inspection control station) is of similar configuration as the first inspection control station 3. It can control basically the same functions of the elevator system as the first inspection control station. According to an embodiment, the second inspection control station 4 (and/or any further inspection control station) has the same configuration as the first inspection control station 3 and provides the same controlling capabilities.

The inspection control station 4 may be merely a remote inspection control station. On the other hand, the inspection control station 3, in addition to being configured as a remote inspection control station, may provide capabilities and hardware (such as appropriate connectors, signal circuitry, fixation elements, etc.) to be permanently installed at the elevator system (such as according to EN 81-20(2014)), to be attached to the storing location, such as 71 or 72, and/or to be wire-connected to the elevator control device 2, or any access point of a communications bus coupled with the elevator control device 2, with the inspection control station 3 being attached or being in proximity of the storing location 71, 72.

For example, the second inspection control station 4 may be carried by a second technician 6 arriving at the jobsite of the elevator system 10, and who shall work together with a first technician 5 using the first inspection control station 3 accessed and detached from the storing location 71 or 72 in a commonly operated inspection or maintenance operation mode. For instance, the first technician 5 may work in the pit and the second technician may work on the car roof, as schematically shown in FIG. 2, wherein both work together for inspecting movement of the elevator car 12. For example, both technicians 5, 6 press the same button on the inspection control station for moving the elevator car 12 up and down, wherein the first technician 5 takes care of the inspection below the elevator car 12 and the second technician 6 takes care of inspection above the elevator car 12. In this way, a two-man operation with respective remotely operated inspection control stations is possible, thus increasing efficiency of the inspection or maintenance operation.

According to an embodiment, the elevator control device 2 is configured to detect the second inspection control station 4, or any further inspection control station, for registration to the elevator control system 1 in the concurrent inspection or maintenance operation mode. For instance, the elevator control device 2 is configured to automatically detect the second inspection control station 4, or any further inspection control station, if it is activated and within appropriate communication distance for registration to the elevator control system 1 in the concurrent inspection or maintenance operation mode.

For example, after detection of more than one inspection control station (such as after detection of inspection control station 4), the elevator control device 2 will switch to a "concurrent mode". In this mode, for example, both inspection control stations 3, 4 have simultaneous control over the elevator car motion. A motion of the elevator car 12 is only possible if both inspection control stations 3, 4 send the same motion command to the elevator control device 2. This is in compliance with EN 81-20(2014), according to which, if more than one inspection control station is switched to "INSPECTION", it shall not be possible to move the car from any of them unless the same push buttons on the inspection control stations are operated simultaneously. Accordingly, according to an embodiment the elevator control device 2 is configured such that a motion of the elevator car 12 is only possible if the first inspection control station 3 and the second inspection control station 4 send a same motion command to the elevator control device 2.

According to an embodiment, the first and second inspection control stations 3, 4 are simultaneously registered with the elevator control device 2 in a concurrent inspection or maintenance operation mode.

According to an embodiment, the elevator control device 2 is configured to switch to the concurrent inspection or maintenance operation mode after detection of more than one inspection control station.

An appropriate feedback for the service person or technician may be provided to indicate, e.g., that a second or further inspection control station is accepted, and/or the motion command status of each accepted inspection control station which may be used in the concurrent inspection or maintenance operation mode.

According to an embodiment, the elevator control system 1 further includes a human machine interface, such as a display 7 on one or each of the inspection control stations 3, 4, configured to provide a feedback for a service person (such as a technician) which indicates at least one of the following: a second or further inspection control station is registered with the elevator control device 2, and a motion command status of each registered inspection control station.

Figure 4:
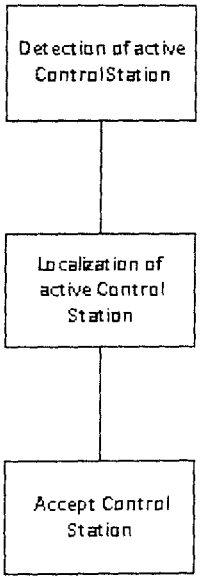
FIG. 4 shows a potential sequence of steps for activation of an inspection control station according to an embodiment.

FIG. 4 shows a potential sequence of steps for activation of an inspection control station according to an embodiment. According to an embodiment, the elevator control device 2 is configured to perform the following steps for activation of the inspection control station 3, or any further inspection control station, such as second inspection control station 4:

In a first step, the inspection control station or any further inspection control station being in an active operation mode is detected. In a second step, localization of the inspection control station or any further inspection control station being in the active operation mode is performed. That is, with such localization, a more or less accurate location of the inspection control station or any further inspection control station may be determined. The localization may be determined together with an accompanying uncertainty parameter. In a third step, the inspection control station or any further inspection control station being in an active operation mode is accepted for the inspection or maintenance operation mode.

According to an embodiment, the elevator control device 2 is configured to localize the inspection control station 3 on the basis of whether wired plug connection, Near Field Communication, Infrared communication, a wireless technology standard for exchanging data over short distances (such as Bluetooth communication), or a wireless mesh network standard communication is used for communication between the inspection control station 3 and the elevator control device 2. That is, localization may be performed depending on the type of signal communication. For example, infrared communication is only possible if there is a line of sight (enabling a light ray) for the infrared light. According to another example, communication according to Near Field Communication may imply a distance of less than, e.g., 1 meter. Detection of wired plug connection may imply that the inspection control station is in or proximate the storing location. Advantageously, in this way, proper behaviour of the technician according to safety standards may be ensured.

According to an embodiment, each of the access points, such as the access points 27, is configured to perform communication with the inspection control station, or any further inspection control station, by one or more of the following: wired plug connection, Near Field Communication, Infrared communication, wireless mesh network standard communication, and a wireless technology standard for exchanging data over short distances. An advantage is that with such kind of communication it is made possible to ensure that the respective inspection control station is in proximity of a particular access point. In other words, if a particular communication, for example Near Field Communication, is not possible (e.g., because the communication range is too large), the inspection or maintenance operation mode is not enabled by the elevator control device 2. The range and/or kind of proximity can be defined by the respective used communication technology.

For example, in this way it may be detected by the elevator control device 2 whether the technician is at the appropriate location for operating the inspection control station in the inspection or maintenance operation mode. For instance, infrared communication can only be made when the inspection control station is in the pit (since only then a line of sight is possible). If a particular inspection or maintenance operation mode requires the technician to operate the inspection control station in the pit, the inspection or maintenance operation mode may only be enabled if an infrared communication between the inspection control station and the elevator control device is possible, thus indicating that the technician is in the pit. According to another example, if a particular inspection or maintenance operation mode requires the technician to operate the inspection control station near an elevator shaft door, the inspection or maintenance operation mode may only be enabled if, e.g., a Near Field Communication between the inspection control station and the respective access point located at the respective elevator shaft door is possible, thus indicating that the technician is in proximity of the elevator shaft door.

According to an embodiment, the elevator control system further includes a human machine interface, such as a display on one or more of the inspection control stations, configured to provide a feedback for a service person which indicates a status of the communication between the elevator control device and the inspection control station or any further inspection control station.

While the invention has been described by taking reference to specific exemplary embodiments, it is to be understood that the invention is not limited to these embodiments and is defined by the scope of the appended claims.

LIST OF REFERENCE SIGNS

1: Elevator control system
2: Elevator control device
3: Inspection control station
4: Inspection control station
5: Technician
6: Technician
7: Display/human machine interface
10: Elevator system
12: Elevator car
14: Counterweight
16: Tension member
17: Elevator drive
18: Elevator shaft
18*a*: front sidewall
18*b*: left sidewall
18*c*: right sidewall
18*d*: rear sidewall
20: Landing door
22: Lowest landing
23: Landing
24: Control board
26: Front door of control board
27: Access point
28: Key lock
29: Communications bus
71: Storing location
72: Storing location
101: Signal communication path
102: Signal communication path
103: Signal communication path

The invention claimed is:

1. An elevator control system, comprising:

an elevator control device for operating an elevator car which is adapted to be operated within an elevator shaft, an inspection control station configured to communicate with the elevator control device for operating at least one function of an elevator system in an inspection or maintenance operation mode, and configured for attachment at a storing location of the elevator system, wherein the storing location is at the elevator car or within the elevator shaft or in proximity of the elevator shaft, wherein the inspection control station is adapted to be detachable from the storing location and configured to operate as remote inspection control station when detached from the storing location through wireless communication with the elevator control device, wherein the inspection control station is configured to be movable and operable in the inspection or maintenance operation mode from inside and outside of the elevator car and within the elevator shaft.

2. The elevator control system according to claim 1, wherein the elevator control device is configured to communicate with the inspection control station being a first inspection control station, and with a second inspection control station such that at least one function of the elevator system is operable by the first inspection control station and the second inspection control station in a concurrent inspection or maintenance operation mode in which the first and second inspection control stations have concurrent control over the at least one function of the elevator system.

3. The elevator control system according to claim 2, wherein the first and second inspection control stations are simultaneously registered with the elevator control device in the concurrent inspection or maintenance operation mode.

4. The elevator control system according to claim 2, wherein the elevator control device is configured to detect the second inspection control station or any further inspection control station for registration to the elevator control system in the concurrent inspection or maintenance operation mode.

5. The elevator control system according to claim 2, wherein the elevator control device is configured to switch to the concurrent inspection or maintenance operation mode after detection of more than one inspection control station.

6. The elevator control system according to claim 2, wherein the elevator control device is configured such that a motion of the elevator car is only possible if the first and second inspection control stations send a same motion command to the elevator control device.

7. The elevator control system according to claim 2, further including a human machine interface configured to provide a feedback for a service person which indicates at least one of the following: a second or further inspection control station is registered with the elevator control device, and a motion command status of each registered inspection control station.

8. The elevator control system according to claim 1, wherein the elevator control device is configured to perform the following steps for activation of the inspection control station, or any further inspection control station:

detection of the inspection control station or any further inspection control station being in an active operation mode, localization of the inspection control station or any further inspection control station being in the active operation mode, accepting the inspection control station or any further inspection control station being in the active operation mode for the inspection or maintenance operation mode.

9. The elevator control system according to claim 1, further including a human machine interface configured to provide a feedback for a service person which indicates a status of the communication between the elevator control device and the inspection control station or any further inspection control station.

10. The elevator control system according to claim 1, wherein the elevator control device is configured to perform communication between the inspection control station and the elevator control device by at least one of the following:

wired plug connection,

Near Field Communication,

Infrared communication, a wireless mesh network standard communication, a wireless technology standard for exchanging data over short distances.

11. The elevator control system according to claim 10, wherein the elevator control device is configured to localize the inspection control station, or any further inspection control station, on the basis of whether wired plug connection, Near Field Communication, Infrared communication, a wireless technology standard for exchanging data over short distances, or wireless mesh network standard communication is used for communication between the respective inspection control station and the elevator control device.

12. The elevator control system according to claim 1, further comprising one or more access points at a respective location of the elevator system, wherein each of the access points is configured to transmit and receive signals to and from the inspection control station when detached from the storing location, or any further inspection control station, through wireless communication and to communicate with the elevator control device.

13. The elevator control system according to claim 12, the one or more access points being located at at least one of the following locations: an inspection panel at a landing, a location of the elevator control device, on top of the elevator car, inside the elevator car, in the pit of the elevator shaft.

14. The elevator control system according to claim 12, further comprising a communications bus coupled with the elevator control device and the one or more access points.

15. The elevator control system according to claim 14, wherein the communications bus is a serial communications bus.

16. The elevator control system according to claim 12, wherein each of the access points is configured to perform communication with the inspection control station, or any further inspection control station, by at least one of the following:

wired plug connection,

Near Field Communication,

Infrared communication, a wireless mesh network standard communication, a wireless technology standard for exchanging data over short distances.

17. The elevator control system according to claim 1, wherein the inspection control station is configured to operate according to standard EN 81-20:2014-11.

18. An elevator system, comprising an elevator car and an elevator shaft, wherein the elevator car is adapted to be operated within the elevator shaft, an elevator control system according to claim 1, a storage location for the inspection control station at the elevator car or within the elevator shaft or in proximity of the elevator shaft, wherein the inspection control station is attached at the storing location and adapted to be detachable from the storing location for operating as remote inspection control station when detached from the storing location through wireless communication with the elevator control device.

* * * * *